US008590825B2

(12) United States Patent
Franchini

(10) Patent No.: US 8,590,825 B2
(45) Date of Patent: Nov. 26, 2013

(54) HOSE REEL CART WITH METAL DRUM AND HEIGHT-ADJUSTABLE MANOEUVRING HANDLE

(75) Inventor: Gaetano Franchini, Fiume Veneto (IT)

(73) Assignee: CLABER S.p.A., Fiume Veneto (PN) (IT)

( * ) Notice: Subject to any disclaimer, the term of this patent is extended or adjusted under 35 U.S.C. 154(b) by 244 days.

(21) Appl. No.: 13/067,639

(22) Filed: Jun. 16, 2011

(65) Prior Publication Data

US 2011/0309182 A1 Dec. 22, 2011

(30) Foreign Application Priority Data

Jun. 17, 2010 (IT) ..... MI2010U0205

(51) Int. Cl.
*B65H 75/40* (2006.01)

(52) U.S. Cl.
USPC ..... 242/403; 242/403.1; 242/404

(58) Field of Classification Search
USPC ..... 242/403, 403.1, 404
See application file for complete search history.

(56) References Cited

U.S. PATENT DOCUMENTS

| | | | | | |
|---|---|---|---|---|---|
| 4,137,939 | A | * | 2/1979 | Chow | 137/355.27 |
| 4,768,546 | A | * | 9/1988 | Brusadin et al. | 137/355.27 |
| 5,308,011 | A | * | 5/1994 | Roman | 242/403.1 |
| 5,758,685 | A | * | 6/1998 | Tisbo et al. | 137/355.27 |
| D503,837 | S | | 4/2005 | Alkalay | |
| 2004/0101351 | A1 | | 5/2004 | Pitcher | |

FOREIGN PATENT DOCUMENTS

| | | |
|---|---|---|
| DE | 75 37 069 | 8/1976 |
| DE | 92 10 081 | 9/1992 |
| DE | 20 2008 015 079 | 2/2009 |
| FR | 2773383 | 7/1999 |
| JP | 47 026312 | 11/1972 |

* cited by examiner

*Primary Examiner* — Sang Kim
(74) *Attorney, Agent, or Firm* — Jacobson Holman PLLC

(57) ABSTRACT

A reel hose cart includes a metal drum formed by a pair of side flanges with radial spokes arranged in a cross, and circular peripheral crown, and by a connecting cross member having parallel sections distributed circumferentially, and a pair of side plates made with plastic material which rotatably carry the drum and to which a metal frame is fixed having three U-shaped tubular elements. One frame top element acts as a maneuvering handle and two frame diverging bottom elements—one of which equipped with wheels—act as a support base on the ground. The top element of frame is formed by a central gripping part and by a pair of parallel side wings inserted in respective through holes of the side plates and blockable therein in axially adjustable position by openable clamps, in particular lever clamps.

2 Claims, 7 Drawing Sheets

HOSE REEL CART WITH METAL DRUM AND HEIGHT-ADJUSTABLE MANOEUVRING HANDLE

This application claims the priority of Italian number MI 2010U 000205 filed Jun. 17, 2010, hereby incorporated by reference.

DESCRIPTION

1. Field of the Invention

The present invention relates to a hose reel cart with metal drum and height-adjustable manoeuvring handle.

2. Background of the Invention

Hose reel carts for gardening are known, which provide a rotating drum having a horizontal axis formed by a pair of side flanges and by a connecting horizontal cross member for the aforesaid flanges, on which a flexible hose intended for irrigation is wound.

The drum is typically made with plastic material and is rotatably supported by a pair of joints or side plates made with plastic material which act as connecting elements for a metal frame having three U-shaped tubular elements, a top one of which acts as manoeuvring handle and two diverging bottom ones—one of which equipped with wheels—act as support base on the ground.

Hose reel carts with whole metal structure are also known, which are heavy and difficult to manoeuvre.

SUMMARY OF THE INVENTION

It is the object of the present invention to make a hose reel cart which has innovative features with respect to the ones currently being used.

In light of such an object, the cart according to the invention is characterized in that it comprises a metal drum formed by a pair of side flanges with radial spokes arranged in a cross, and circular peripheral crown, and by a connecting cross member having parallel sections distributed circumferentially, and a pair of side plates made with plastic material which rotatably carry said drum and to which a metal frame is fixed having three U-shaped tubular elements, a top one of which acts as manoeuvring handle and two diverging bottom ones—one of which equipped with wheels—act as support base on the ground, said top element being formed by a central gripping part and by a pair of parallel side wings inserted in respective through holes of said side plates and blockable therein in axially adjustable position by means of openable clamps.

The hose reel cart according to the present invention has an extremely lightweight structure, essentially resulting from the conformation of the metal drum, and due to the type of coupling between the handle and the two side plates provides the possibility of adjusting the height of the handle, thus adapting it to the person operating the cart and to the circumstance of use. Hence, it is also possible to minimize the vertical volume of the cart, thus facilitating transport and storage.

BRIEF DESCRIPTION OF THE DRAWINGS

A practical embodiment of the cart according to the finding is shown by way of non-limiting example in the accompanying drawings, in which.

DETAILED DESCRIPTION OF THE PREFERRED EMBODIMENTS

Figure 1:
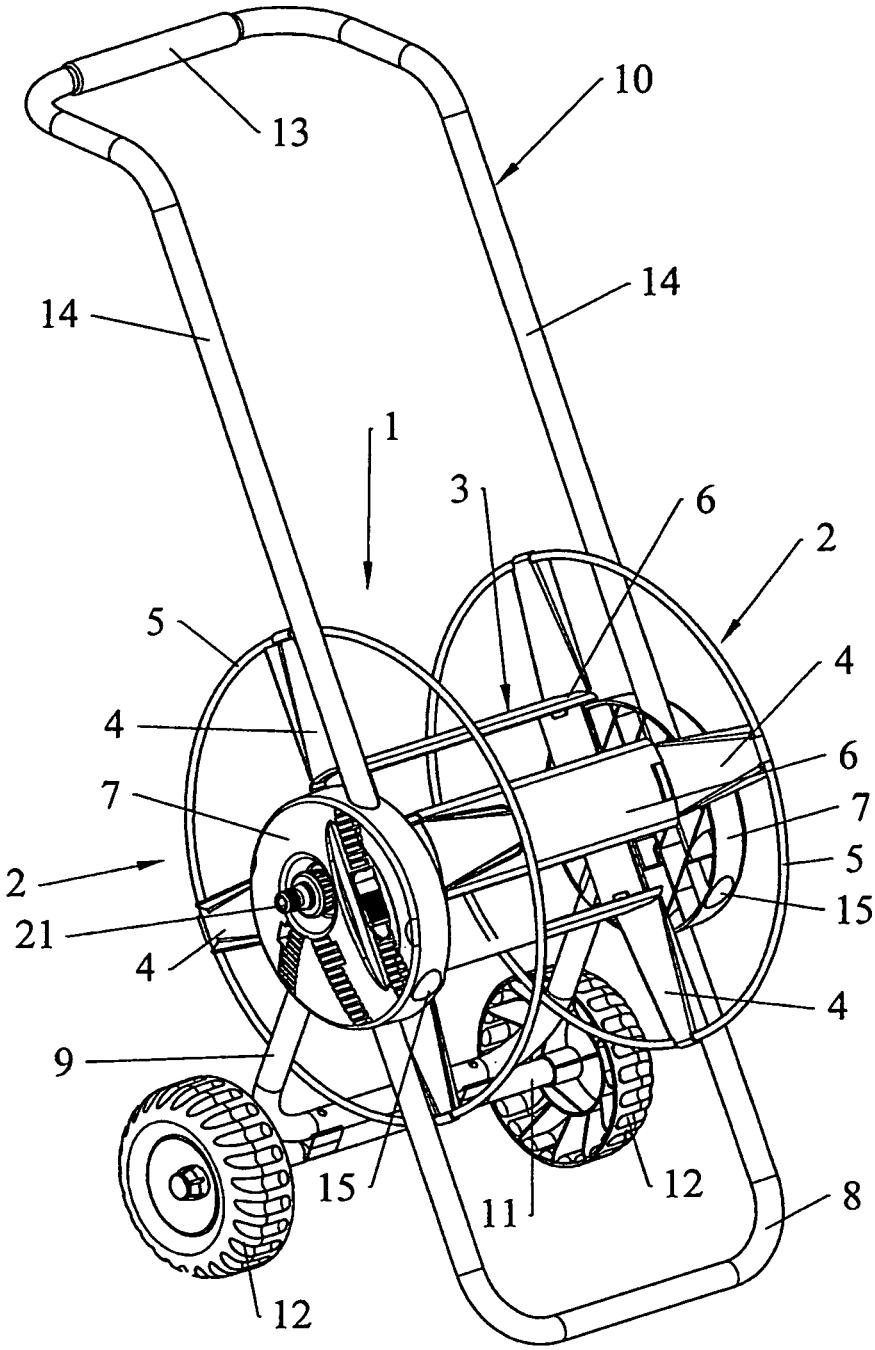
FIG. 1 shows a perspective view of the cart.
Figure 2:
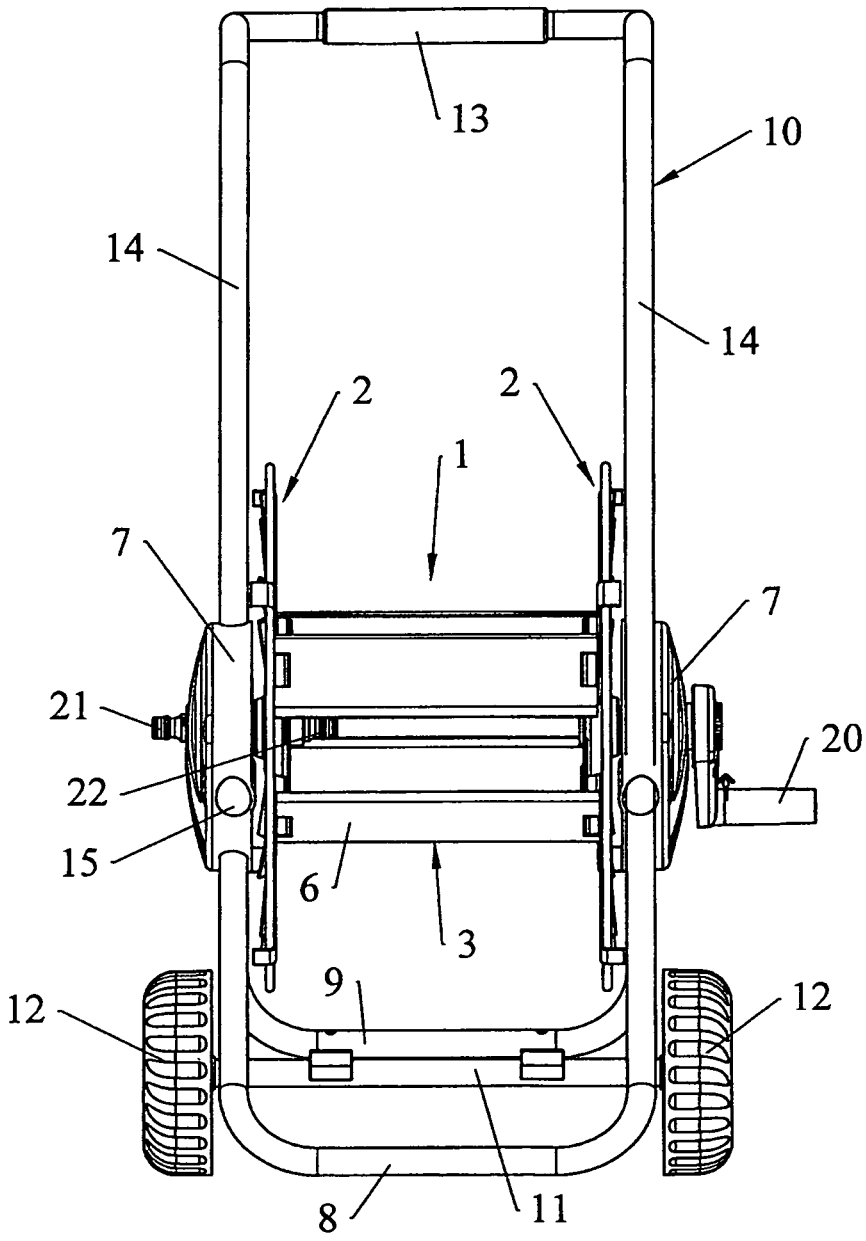
FIG. 2 shows a front view of the cart.
Figure 3:
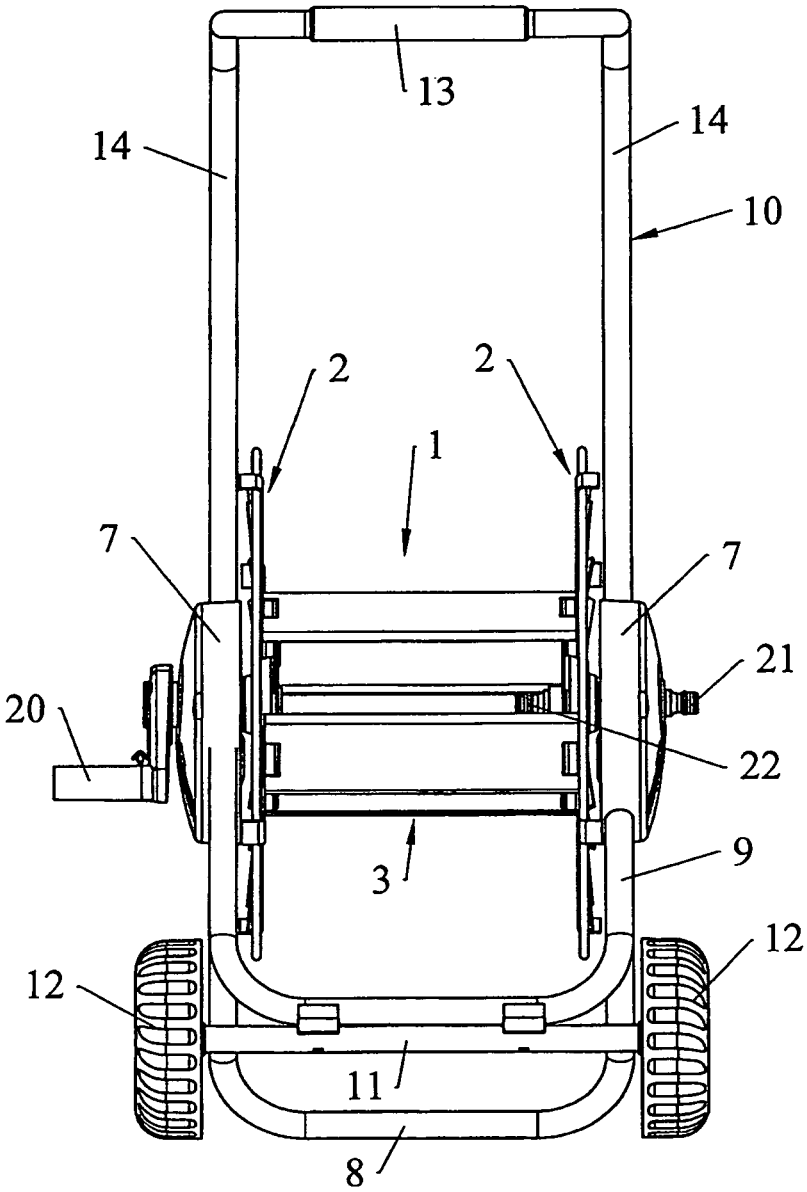
FIG. 3 shows a rear view of the cart.
Figure 4:
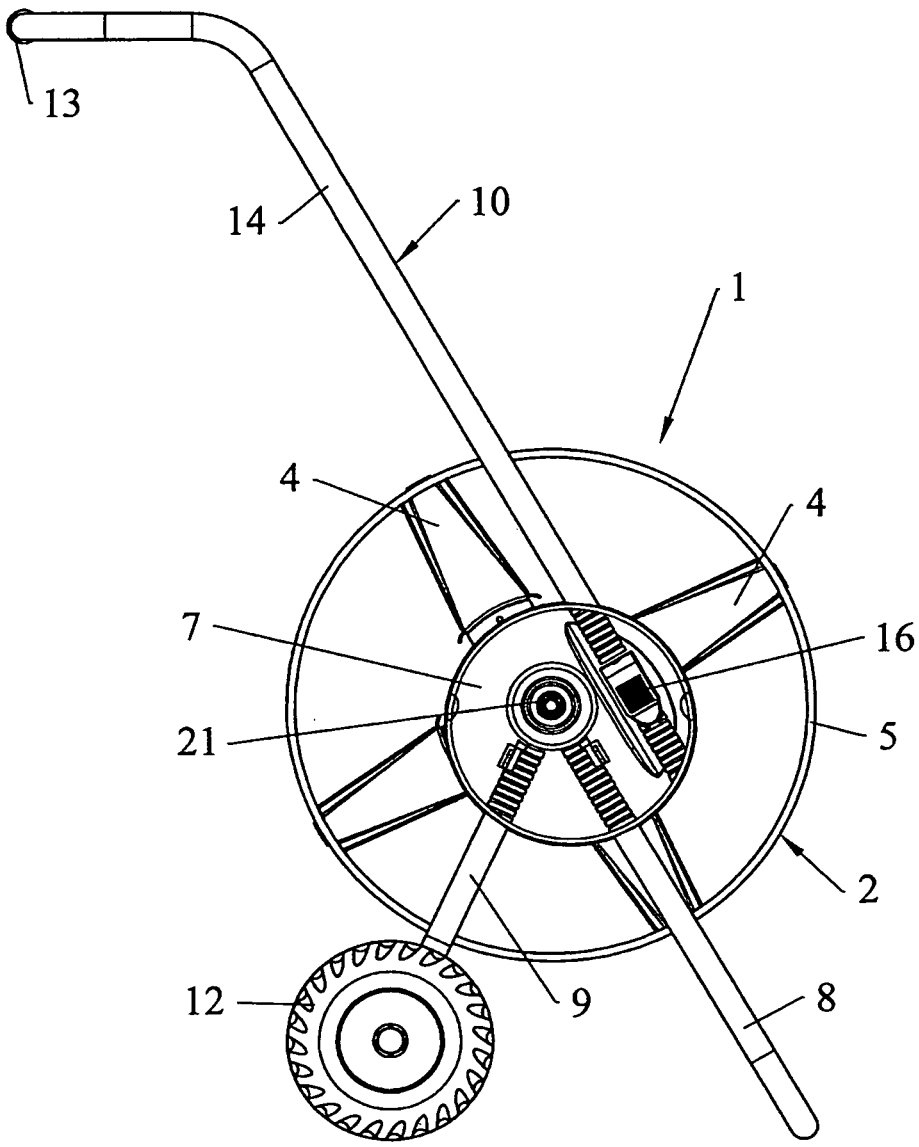
FIG. 4 shows the cart from the left with respect to FIG. 2.
Figure 5:
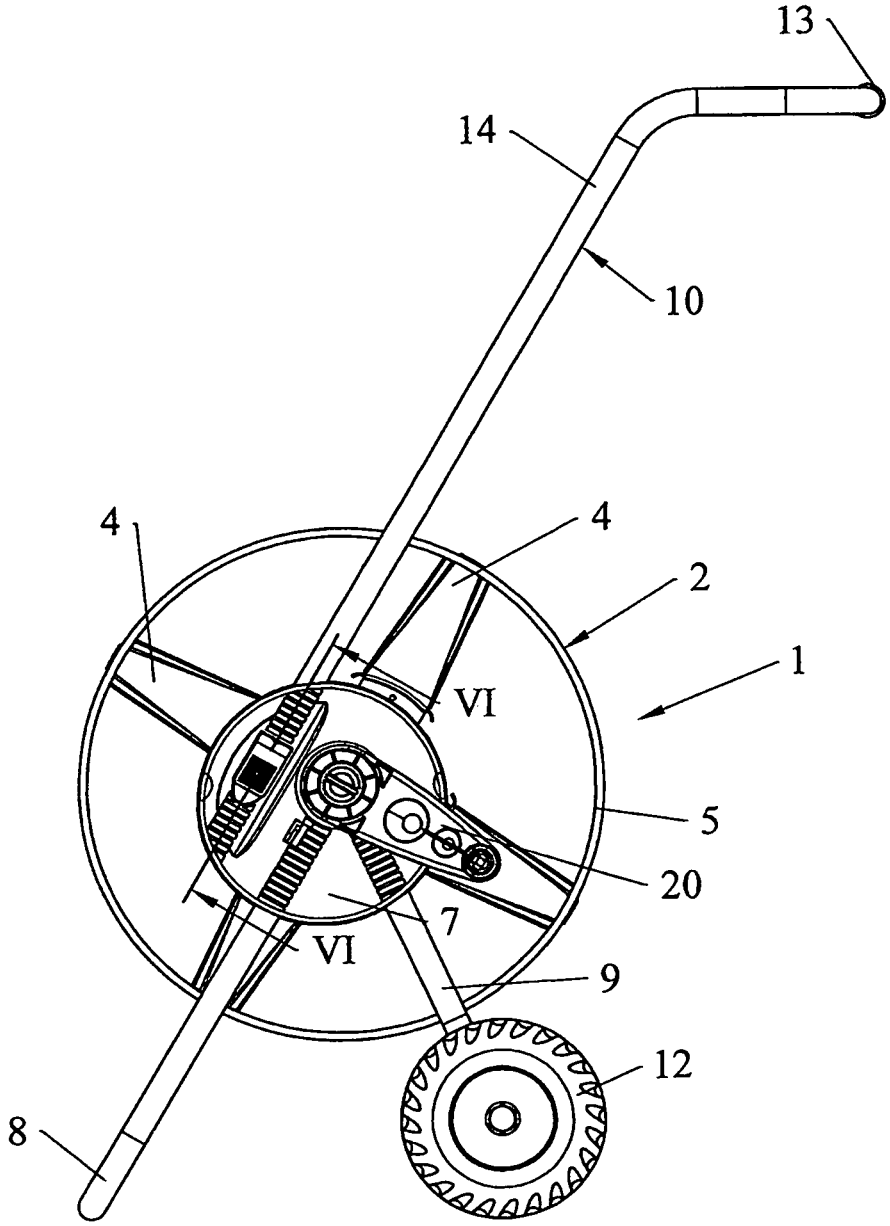
FIG. 5 shows the cart from the right with respect to FIG. 2.

The hose reel cart shown in the drawings comprises a metal drum 1 formed by a pair of side flanges 2 and by a connecting cross member 3. All flanges 2 are formed by two spokes 4 arranged perpendicularly in a cross and by a circular peripheral crown 5 which joins the outer ends of the two spokes. The cross member 3 is in turn formed by parallel and concave sections of circumference 6.

Drum 1 is rotatably carried by a pair of side plates 7 made with plastic material, which also act as connecting joints for three parts of frame consisting of respective U-shaped metal tubular elements 8, 9 and 10.

Two tubular elements 8 and 9 divergingly extend downwards from the two plates 7 to act as support base on the ground for the hose reel cart. The front element 8 directly rests on the ground, while the rear element 9 is fixed to an axis 11 equipped with free turning wheels 12.

Figure 6:
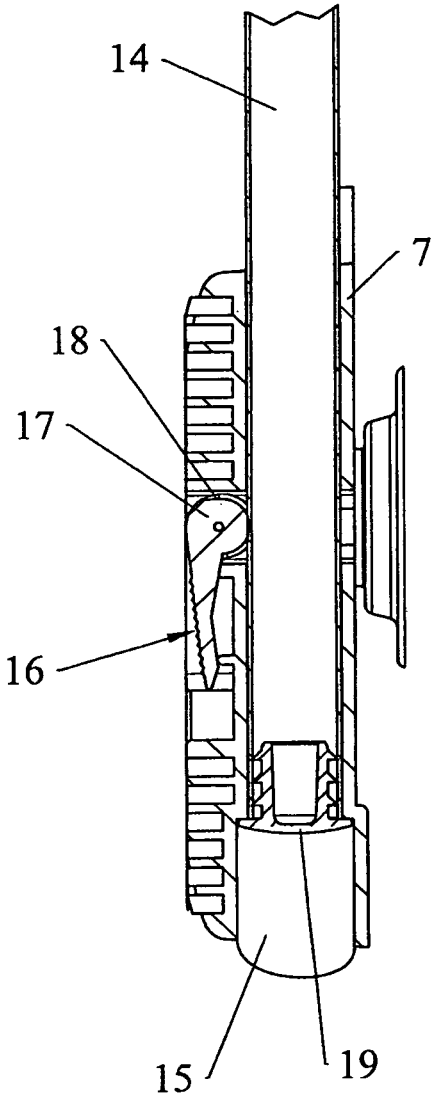
FIG. 6 shows an enlarged detail of the cart in section according to the line VI-VI in FIG. 5.

Instead, the tubular element 10 extends upwards and backwards with respect to the plates 7 to act as manoeuvring handle for the cart. A central part 13 of the tubular element 10 acts as grip for the user, while the two side wings 14 connect the grip to the two plates 7, where they are inserted in respective through holes 15 (FIG. 6). Each plate 7 has a lever clamp 16 (FIG. 6), which has an enlarged circular hub 17 equipped with a bevelled peripheral part 18.

When the two clamps 16 are in the position of FIG. 6, the two wings 14 of handle 10 are blocked by friction inside the respective holes 15 of the plates 7 and the user may use handle 10 to move the cart. Instead, by rotating the two clamps by 90° so as to bring their bevelled parts 18 to the wings 14 of handle 10, the two wings 14 may be run within the through holes 15 so as to adjust the vertical extension of the handle differently. The two clamps are then brought back to the position in FIG. 6 to block handle 10 in the new position.

Figure 7:
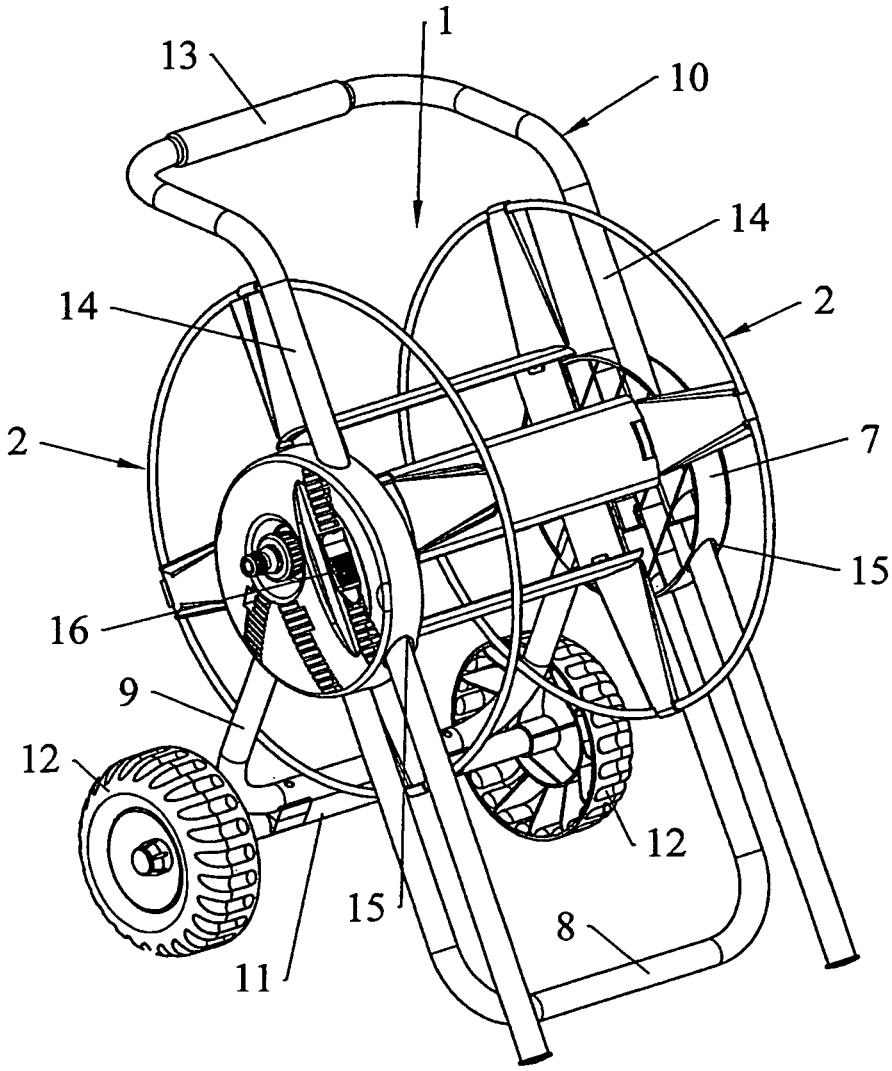
FIG. 7 shows a perspective view of the cart in position of minimum vertical volume.

The two wings 14 may also be run in the holes 15 until the ends thereof (closed by plugs 19, as shown in FIG. 6) reach the resting ground of the cart (FIG. 7). Thus, the cart is arranged in a condition of minimum vertical volume, which is useful for transport and storage purposes.

Finally, the cart is completed with a crank 20 arranged at the side of one of the plates 7 (FIGS. 2, 3, 5 and 7) to execute the rotation of drum 1, and with two male fittings 21 and 22 arranged at the two sides of the other plate 7 (FIGS. 1-4) and hydraulically connected to each other to execute the hydraulic connection between a flexible hose (not shown), which is windable about the cross member 3 of drum 1, and a further flexible hose (not shown) intended for the connection to a water intake.

The invention claimed is:

1. A reel hose cart comprising a metal drum formed by a pair of side flanges with radial spokes arranged in a cross and circular peripheral crown and by a connecting cross member having parallel sections distributed circumferentially, and a pair of side plates which rotatably carry said drum and to which a handling frame is fixed having three U-shaped tubular elements, a top tubular element being formed by a central gripping part and by a pair of parallel side wings and two diverging bottom tubular elements constitute a support base on the ground, one of said bottom tubular elements being equipped with wheels, said side plates being circular plates provided with passing-through holes located laterally and perpendicular to an axis of rotation of the drum and said side wings being slidingly axially inserted in said passing-through holes of said side plates and being blockable therein in axially adjustable position by openable lever clamps mounted on said side plates.

2. The cart according to claim 1, wherein said lever clamps have an enlarged circular hub adapted to act by friction on a respective wing to fix a position thereof inside a respective passing-through hole, said enlarged hub is equipped with a bevelled peripheral part adapted to allow movement of said wing along said passing-through hole when the clamp is rotated to bring said bevelled part in contact with said wing.

* * * * *